United States Patent [19]

Koyanagi et al.

[11] 4,182,942

[45] Jan. 8, 1980

[54] PUFFER-TYPE GAS-BLAST CIRCUIT BREAKER

[75] Inventors: Osamu Koyanagi; Ken-ichi Natsui; Yoshio Yoshioka, all of Hitachi, Japan

[73] Assignee: Hitachi, Ltd., Japan

[21] Appl. No.: 792,004

[22] Filed: Apr. 28, 1977

[30] Foreign Application Priority Data

May 4, 1976 [JP] Japan ..... 51-49973

[51] Int. Cl.[2] ..... H01H 33/88

[52] U.S. Cl. ..... 200/148 A; 200/148 C; 200/150 G

[58] Field of Search ..... 200/148 A, 150 G, 148 C

[56] References Cited

U.S. PATENT DOCUMENTS 3,987,261 10/1976 McConnell ..... 200/150 G

FOREIGN PATENT DOCUMENTS 1150428 6/1963 Fed. Rep. of Germany ..... 200/148 C

*Primary Examiner*—Robert S. Macon
*Attorney, Agent, or Firm*—Craig and Antonelli

[57] ABSTRACT

A puffer type gas-blast circuit breaker includes at least one interrupting unit mounted in a vessel filled with an arc-extinguishing gas of a unitary pressure. The interrupting unit comprises: a fixed contact; a movable contact movable toward and away from the fixed contact to be engaged with and to be disengaged from the fixed contact respectively, the movable contact having therein an axial hollow portion, wherein an arc is established between the contacts upon disengagement of the movable contact from the fixed contact; a compression chamber filled with an arc extinguishing gas; a suction chamber, wherein an arc extinguishing gas within the compression chamber is compressed and the volume of the suction chamber is enlarged upon movement of the movable contact away from the fixed contact, and wherein a pressure difference between the compression chamber and the suction chamber causes the arc extinguishing gas to be directed from the compression chamber through the axial hollow portion into the suction chamber thereby to be blown against an arc produced between the fixed contact and the movable contact; and means provided in the suction chamber for cooling an arc extinguishing gas introduced into the suction chamber to suppress a pressure rise within the suction chamber for maintaining a sufficiently large pressure difference between the compression chamber and the suction chamber, thereby shortening an arcing time and improving a breaking performance.

28 Claims, 11 Drawing Figures

PUFFER-TYPE GAS-BLAST CIRCUIT BREAKER

This invention relates to a puffer type gas-blast circuit breaker, and more particularly to a circuit breaker of the type described, which includes a compression chamber and a suction chamber, and in which a pressure difference between the compression chamber and the suction chamber causes an arc extinguishing gas to be blown against an arc produced between the contacts.

A puffer type gas-blast circuit breaker is known as a small-size, large-capacity circuit breaker of a simple construction.

A prior art puffer type gas-blast circuit breaker includes at least one interrupting unit mounted in a vessel filled with an arc extinguishing gas such as a $SF_6$ gas of a unitary pressure. The interrupting unit includes a pair of contacts which are positioned in alignment with but in opposed relation to each other and movable towared and away from each other so as to be engaged with and to be disengaged from each other, respectively. At least one of the contacts has therein an axial hollow portion. The interrupting unit further includes a compression chamber filled with an arc extinguishing gas, and an suction chamber. When a pair of contacts move away from each other, the arc extinguishing gas in the compression chamber is compressed, and the volume of the suction chamber is enlarged. When a pair of contacts are disengaged from each other, then the compression chamber and the suction chamber communicate with each other through the axial hollow portion of the one contact, so that a pressure difference between the compression chamber and the suction chamber causes an arc extinguishing gas from the compression chamber to be directed into the suction chamber so as to be blasted against an arc produced between the pair of contacts, thereby extinguishing the arc.

According to the aforesaid prior art puffer type gas-blast circuit breaker, there may be obtained a large pressure difference between the compression chamber and the suction chamber and hence an arc extinguishing gas may be effectively blown against an arc produced between the both contacts, and hence an arcing time may be shortened. However, upon breaking or interruption of a large amount of current, an arc produced between the both contacts heats an extinguishing gas, which in turn is introduced into the suction chamber, so that a pressure in the suction chamber is increased as compared with the pressure of gas filled in the vessel. In the above case, there results lack of pressure difference between the compression chamber and the suction chamber, thus resulting in extended arcing time and lowering in breaking performance.

It may be one of solutions to provide a cooling means in an axial hollow portion provided in at least one of the pair of contacts for cooling an arc extinguishing gas heated and introduced into the suction chamber. However, there is provided only a limited space in the axial hollow portion provided in the contact, and thus it is impossible to dispose in the axial hollow portion a cooling means which has a sufficient cooling performance. In addition, upon breaking or interruption of a large amount of current, an arc produced between the both contacts causes an unusual pressure in the neighborhood of an arc produced between the both contacts. This unusual pressure hinders the compression of gas in the compression chamber but aids in expansion of gas in the suction chamber. In case where a cooling means is positioned within the axial hollow portion provided in the contact, then the action of an unsual pressure on the suction chamber is hindered, with the result that an insufficient pressure difference between the compression chamber and the suction chamber is created.

It is an object of the present invention to provide a puffer type gas-blast circuit breaker which may maintain a sufficiently large pressure difference between a compression chamber and a suction chamber.

It is another object of the present invention to provide a puffer type gas-blast circuit breaker which comprises a cooling means in a suction chamber for cooling an arc extinguishing gas heated and introduced into the suction chamber and suppressing a pressure rise in the suction chamber.

It is a further object of the present invention to provide a puffer type gas-blast circuit breaker, in which an initial volume of a suction chamber within which is disposed the cooling means is reduced for enhancing a suction effect of the suction chamber.

It is a still further object of the present invention to provide a puffer type gas-blast circuit breaker of an arrangement that when a pair of contacts relatively move a given distance in the direction away from each other, the compression chamber is communicated with the suction chamber, thereby to blast an initial positive blow of arc-extinguishing gas against the arc between the contacts.

According to the present invention, there is provided a puffer type gas-blast circuit breaker having at least one interrupting unit mounted in a vessel filled with an arc extinguishing gas of a unitary pressure, the aforesaid interrupting unit comprising: a pair of contacts positioned in alignment with but in opposed relation to each other, and movable toward and away from each other to be engaged with and to be disengaged from each other respectively, at least one of the pair of contacts having therein an axial hollow portion, said hollow portion having an opening in that axial free end of the aforesaid at least one contact which is opposed to the end of the other contact, wherein an arc is established between said pair of contacts upon disengagement of the pair of contacts from each other; a first cylinder and a first piston within the first cylinder to define a compression chamber filled with an arc extinguishing gas, said first piston and cylinder being movable relative to each other in association with the relative movement of said pair of contacts; a first communicating means for communicating the compression chamber with the axial hollow portion through the aforesaid opening, when said pair of contacts are disengaged from each other; a second cylinder and a second piston within said second cylinder to define a suction chamber, the aforesaid second piston and cylinder being movable relative to each other in association with the relative movement of said pair of contacts; a second communicating means for communicating the axial hollow portion with the suction chamber, wherein when said pair of contacts are moved away from each other to be disengaged from each other, an arc extinguishing gas in the compression chamber is compressed and a volume of the suction chamber is enlarged, and wherein a pressure difference between the compression chamber and the suction chamber causes an arc extinguishing gas to be directed from the compression chamber via the first communication means, the opening, the axial hollow portion, and the second communicating means into the suction chamber to blow against an arc produced between said pair of contacts; and means disposed in the suction chamber for cooling an extinguishing gas introduced into the suction chamber.

According to the circuit breaker of the present invention, both of a pair of contacts may be relatively moved or one of a pair of the contacts is movable and the other may be fixed. In addition, both of a pair of the contacts may have axial hollow portions, respectively.

Still alternatively, the first cylinder and the first piston may both be moved, or one of them is movable and the other may be fixed. In this case, one of them may be coupled to a contact. Likewise, both of the second cylinder and the second piston may be moved, or one of them is movable and the other is fixed. In this case, one of them may be coupled to a contact.

Figure 1:
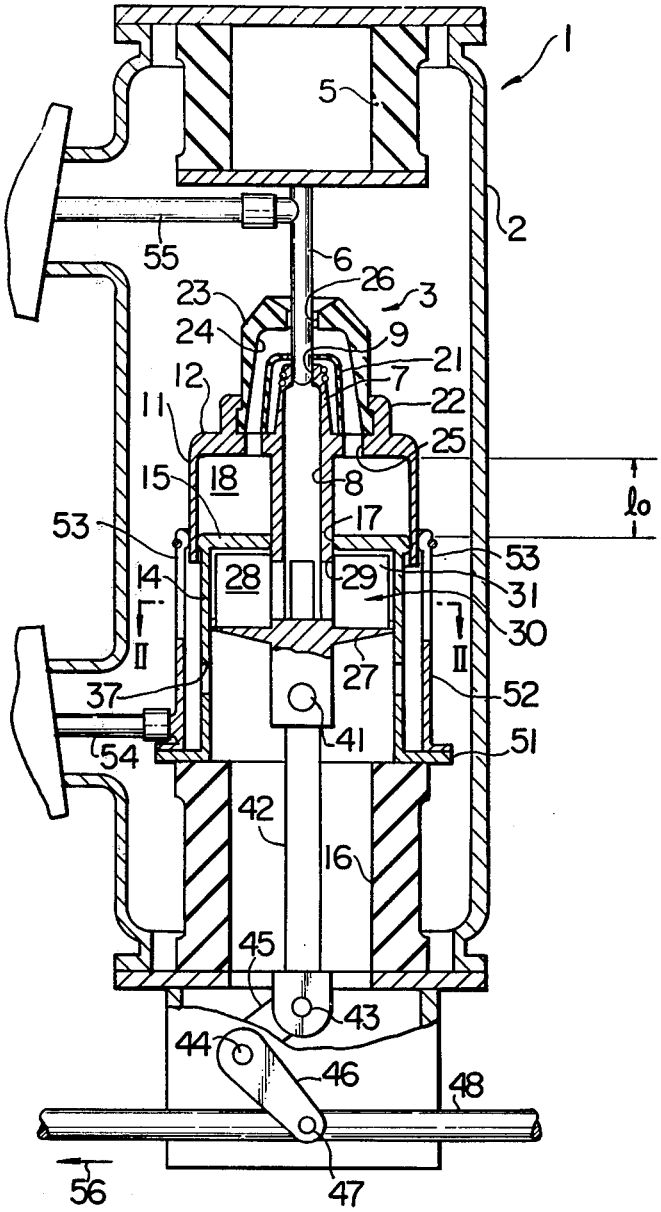
FIG. 1 is a cross-sectional view of a puffer type gas-blast circuit breaker in its open position according to the present invention.

Referring to FIG. 1, there is generally shown at 1 a puffer type gas-blast circuit breaker according to the present invention. The circuit breaker 1 includes a vessel 2 filled with an arc extinguishing gas of a unitary pressure, and at least one interrupting unit 3 mounted in the vessel 2. The interrupting unit 3 includes a solid fixed contact 6 which is secured through the medium of a tubular insulating member 5 to the vessel 2, and a movable contact 7 in alignment with but in opposed relation to the fixed contact 6 and movable in the direction towards and away from the fixed contact 6 so as to be engaged with and to be disengaged from the fixed contact 6, respectively. The movable contact 7 includes therein an axial hollow portion 8 having an opening 9 which opens in that axial free end face of the movable contact 7 which is opposed to the fixed contact 6. When the circuit is in its closed position, the opening 9 is closed with the fixed contact 6.

A first cylinder 11 has a substantially closed end 12 and is integral with the movable contact 7 in a manner that the movable contact 7 extends through the substantially closed end 12 of the first cylinder 11 in concentric relation therewith. A second cylinder 14 having a substantially closed end 15 and an open end is secured through an insulating member 16 to the vessel 2. The substantially closed end 15 of the second cylinder 14 is slidably fitted in the first cylinder 11, thereby forming or serving as a first piston. The first piston 15 is formed with a hole 17, and the movable contact 7 is fitted in the hole 17 slidingly sealingly. A compression chamber 18 is defined by the substantially closed end 12 of the first cylinder 11, the first piston 15, the inner peripheral surface of the first cylinder 11, and the outer periheral surface of the movable contact 7.

Disposed on the side opposite to the compression chamber 18 with respect to the substantially closed end 12 of the first cylinder 11 is an insulating cover 21 which encompasses on free end portion of the movable contact 7. Disposed on the side opposite to the compression chamber with respect to the substantially closed end 12 of the first cylinder 11 is an annular flange 22 which is integral with the end 12. An insulating nozzle 23 is secured to the annular flange 22 in a manner to surround the insulating cover 21. An arc-extinguishing gas guide passage 24 is defined between the inner peripheral surface of the insulating nozzle 23 and the outer peripheral surface of the insulating cover 21, and is communicated through holes 25 provided in the substantially closed end 12 of the first cylinder 11 with the compression chamber 18. Thus, when the movable contact 7 is disengaged from the fixed contact 6, the compression chamber 18 is communicated via holes 25, passage 24 and opening 9 with the axial hollow portion 8 in the movable contact 7.

The insulating nozzle 23 is formed with a throat portion 26 which is positioned in coaxial relation to the fixed contact 6. The throat portion 26 in the insulating nozzle 23 is capable of being blocked by the fixed contact 6.

Integrally connected to that end of the movable contact 7 opposite to the free end portion thereof is a second piston 27, which is slidably fitted in the second cylinder 14. In this manner, a suction chamber 28 is defined by the substantially closed end 15 of the second cylinder 14, the second piston 21, the inner peripheral surface of the second cylinder 14, and the outer peripheral surface of the movable contact 7.

The peripheral wall of the opposite end portion of the movable contact 7 has therein openings 29, and the axial hollow portion 8 in the movable contact 7 may be communicated through the openings 29 with the suction chamber 28.

Figure 2:
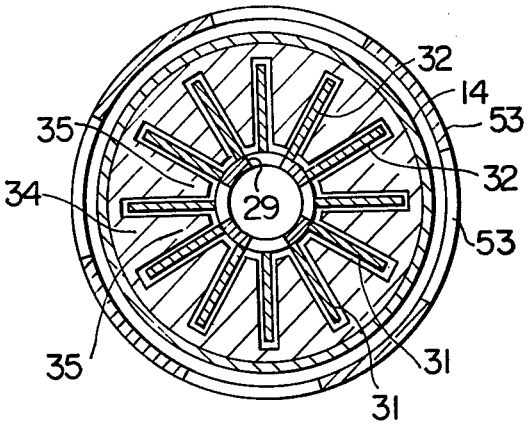
FIG. 2 is a cross-sectional view taken along the line II—II of FIG. 1.

A cooling means 30 is disposed in the suction chamber 28. The cooling means 30 is secured to that surface of the second piston 27 which is opposed to the substantially closed end 15 of the second cylinder 14, and includes a plurality of fin members 31 which affords excellent thermal conductivity and extend from the outer peripheral surface of the movable contact 7 towards the inner peripheral surface of the second cylinder 14. As shown in FIG. 2, the fin members 31 are positioned around the movable contact 7 at an equal angular spacing, and the adjacent two fin members 31 define therebetween arc-extinguishing-gas passages 32, respectively. The radially inner ends of some of these passages 32 are directly communicated with the holes 29 provided in the peripheral wall of the movable contact 7.

The suction chamber 28 is preferably adapted to produce a pressure as low as possible, as compared with a gas pressure within the vessel 2, thereby providing a large pressure difference between the suction chamber 28 and the compression chamber 18. Accordingly, it is preferable to minimize the initial volume of the suction chamber 28. For this reason, a cylindrical member 34 is secured on the inner periphery of the second cylinder 14, as shown in FIG. 2. The cylindrical member 34 is formed with projections 35 extending radially inwardly which substantially occupy the passages 32 defined between the fin members 31 respectively, thereby minimizing the initial volume of the suction chamber 28. The cylindrical member 34 should preferably be made of a material having high thermal conductivity for aiding in cooling of an arc extinguishing gas, when the arc extinguishing gas is in contact with the cylindrical member 34.

Openings 37 are formed in the peripheral wall of the second cylinder 14, and the suction chamber 28 may be communicated with a space within the vessel 2, when that surface of the second piston 27 opposite to the substantially closed end 15 of the second cylinder 14 overlaps the openings 37. The position of the openings 37 is such that, as will be described hereinafter, when the movable contact 7 is moved a given distance from the fixed contact 7, the suction chamber 28 may be communicated with a space in the vessel 2.

The movable piston 27 is connected to a connecting member 42 by means of a pin 41, and the connecting member 42 is connected to one arm 45 of a 'L' shaped link by means of a pin 43, while the 'L' shaped link is pivotally supported by a pin 44. The other arm 46 of the 'L' shaped link is pivotally connected to a driving rod 48 by means of a pin 47, and the driving rod 48 in turn is connected to an actuator not shown.

An open end of the second cylinder 14 is formed with a flange 51, and a cylindrical collector 52 is secured to the flange 51 in concentric relation to the second cylinder 14. The collector 52 is formed at its free end with a plurality of contacts 53 which are circumferentially spaced from each other, and the contacts 53 are urged against the outer peripheral surface of the first cylinder 14 by means of circular spring. One terminal 54 is connected to the peripheral wall of the collector 52, and the other terminal 55 is coupled to the fixed contact 6.

Description will now be given of the breaking operation, hereunder.

Figure 3:
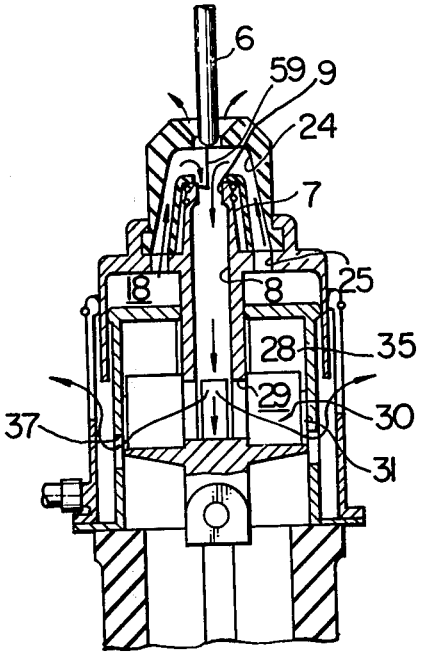
FIG. 3 is a cross-sectional view of a circuit breaker of FIG. 1, the breaker being in its open position.

An actuator means not shown is operated to move the driving rod 48 in an arrow direction 56. Accordingly to the movement of the driving rod 48, arms 46, 45 of the 'L' shaped link are moved in the direction to keep the movable contact 7 away from the fixed contact 6 through the medium of the connecting member 42. The movement of the movable contact 7 in the direction away from the fixed contact 6 causes the first cylinder 11 integral with the movable contact 7 to move in the direction towards the first piston 15 as well as causes the second piston 27 integral with the movable contact 7 to move in the direction away from the substantially closed end 15 of the second cylinder 14. As a result, an arc extinguishing gas within the compression chamber 18 is compressed, and the volume of the suction chamber 28 is enlarged, resulting in a large pressure difference between the compression chamber 18 and the suction chamber 28. As shown in FIG. 3, when the movable contact 7 is disengaged from the fixed contact 6, a pressure difference between the compression chamber 18 and the suction chamber 28 causes an arc extinguishing gas in the compression chamber 18 to be directed through the holes 25 in the substantially closed end 12 of the first cylinder 11, guide passages 24, and opening 9, into the axial hollow portion 8 and then through the holes 29 provided in the peripheral wall of the movable contact 7 into the suction chamber 28. When an arc extinguishing gas flows from the compression chamber 18 through the passage 24 and opening 9 into the axial hollow portion 8, the arc extinguishing gas is blown against an arc produced between the movable contact 7 and the fixed contact 6, so that the arc is extinguished.

When an arc extinguishing gas is in contact with the arc, the arc extinguishing gas is heated by the arc and then directed through the axial hollow portion 8 and openings 29 into the suction chamber 28. The arc extinguishing gas which has been introduced into the suction chamber 28 is cooled by the fin members 31 in the cooling means 30 due to its contact with the fin members 31, so that a pressure rise within the suction chamber 28 may be suppressed. The arc extinguishing gas thus cooled is discharged through the openings 37 into the space in the vessel 2.

When the movable contact 7 is further moved away from the fixec contact 6, so that the fixed contact 6 is extracted from the throat portion 26 in the nozzle 23, then an arc extinguishing gas compressed within the compression chamber 18 is discharged through the throat portion 26 into the vessel 2. In this manner, there is produced a stream of a gas flowing toward the fixed contact 6 and movable contact 7, so that an arc produced between the both contacts may be positively extinguished.

Figure 4:
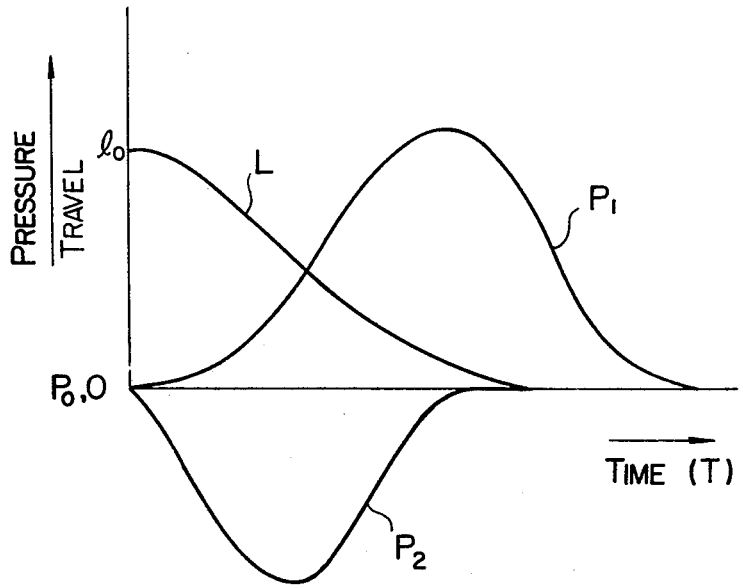
FIG. 4 is a contact travel and pressure characteristic diagram of the circuit breaker of FIG. 1.

FIG. 4 is a diagram showing the relationship among a travel (L) of the movable contact, a pressure (P1) in the compression chamber 18, and a pressure (P2) in the suction chamber 28, upon the current interruption of a puffer type gas-blast circuit breaker according to the present invention. As can be seen from FIG. 4, since an arc extinguishing gas flowing into the suction chamber 28 is cooled by the cooling means 30, a pressure (P2) in the suction chamber 28 may be maintained lower than a pressure (P0) in the vessel 2, thereby maintaining a large pressure difference between the compression chamber 18 and the suction chamber 28.

The openings 37 provided in the peripheral wall of the second cylinder 14 are so located that, at the time when the movable contact 7 is moved away from the fixed contact 6 and as a result a pressure difference between a negative pressure or vacuum (P2) in the suction chamber 28 and the pressure (P1) in the compression chamber 18 is increased to an extent to cause a flow of an arc extinguishing gas which is strong enough for extinguishing an arc, i.e., when the movable contact 7 is moved a distance of $\frac{1}{2}$ to $\frac{1}{3}$ of the full span of contact travel (lo), the openings 37 may be communicated with the space in the vessel 2, and hence the suction chamber 28 may be brought into communication with the space in the vessel 2.

Figure 5:
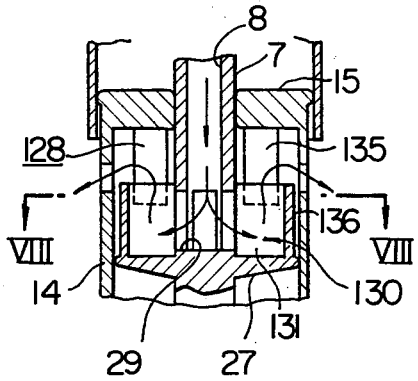
FIG. 5 is a cross-sectional view of a modification of a cooling means.
Figure 6:
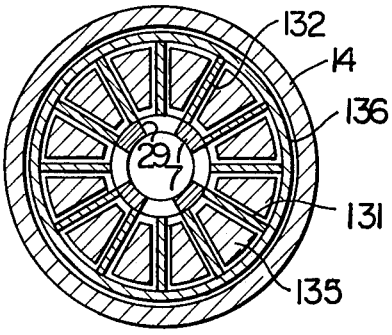
FIG. 6 is a cross-sectional view taken along the line VI—VI of FIG. 5.

FIGS. 5 and 6 show a modification of the cooling means, and like parts are designated like reference numerals in common with those shown in FIG. 1. A cooling means 130 shown in FIGS. 5 and 6 includes a cylindrical member 136 secured to the periphery of the second piston 27 and extends towards the substantially closed end 15 of the second cylinder 14, and a plurality of fin members 131 which radially extend from the inner peripheral surface of the cylindrical member 136 towards the outer peripheral surface of the movable contact 7. As shown in FIG. 6, the fin members 131 are circumferentially equi-distantly spaced apart from each other, around the movable contact 7 and the adjacent two of the fin members 131 define therebetween arc extinguishing gas passages 132, respectively. The radially inner ends of some of these passages 132 are directly communicated with the openings 29 in the peripheral wall of the movable contact 7. The cylindrical member 136 and fin members 131 are made of a material of high thermal conductivity.

For reducing an initial volume of the suction chamber, as shown in FIG. 6, elongated members 135 depend from the inner surface of the substantially closed end 15 of the second cylinder 14 and substantially occupy or fill the passages 132 between the fin members 131, respectively. The elongated members 135 are made of a material of high thermal conductivity, and thus aids in cooling of an arc extinguishing gas, when the gas is in contact with the members 135.

With the aforesaid arrangement, as shown in FIG. 5, an arc extinguishing gas which has been heated by an arc produced between the both contacts is directed, as shown by an arrow, through the axial hollow portion 8 and holes 29 into an suction chamber 128, and the arc extinguishing gas is buffled by the cylindrical member 136 in the cooling means 130 so as to flow towards the elongated members 135. In other words, an arc extinguishing gas in the suction chamber 128 may be in contact with the fin members 131 and elongated members 135 for a further extended period of time, thereby enhancing their cooling effect.

Figure 7:
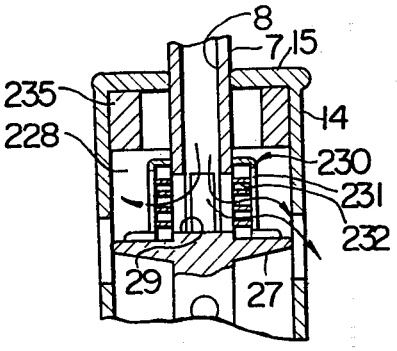
FIG. 7 is a cross-sectional view of another modification of a cooling means.
Figure 8:
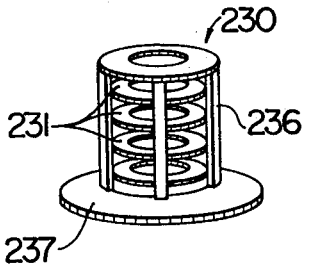
FIG. 8 is a perspective view of the cooling means shown in FIG. 7.

FIGS. 7 and 8 show still another embodiment of the cooling means, and like parts are designated like reference numerals in common with those shown in FIG. 1. A cooling means 230 shown in FIGS. 7 and 8 includes a plurality of ring-shaped discs positioned around the movable contact 7 in concentric relation but axially spaced from each other, while the adjacent two of the discs 232 define therebetween passages 232, respectively, with the radially inner ends of the passages 232 being open to the holes 29 provided in the periperal wall of the movable contact 7. The discs 231 are connected to each other by means of a plurality of elongated members spaced along the circumference thereof. The elongated members 236 have ends thereof secured to a ring-shaped base 237 which is secured to the second piston 27. At least the ring-shaped discs 231 among the members including ring-shaped discs 231, elongated members 236 and ring-shaped base 237 are made of a material having high thermal conductivity.

A ring member 235 is preferably secured to or integral with the inner peripheral surface of the second cylinder 14, occupying a space defined between the outer peripheral surface of the ring-shaped discs and the inner peripheral surface of the second cylinder for reducing an initial volume of the suction chamber 228. In addition, the ring-shaped member 235 should preferably be made of a material having high thermal conductivity.

Figure 9:
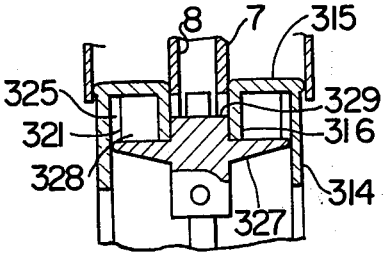
FIG. 9 is a cross-sectional view showing part of another embodiment of the circuit breaker according to the present invention.

FIG. 9 shows part of another embodiment of the present invention, and like parts are designated like reference numerals in common with those shown in FIG. 1. The puffer type gas-blast circuit breaker shown in FIG. 7 differs from that shown in FIG. 1 in that, when the circuit is in its closed position, an axial hollow portion provided in a movable contact is not communicated with a suction chamber. More particularly, an inner cylindrical member 316 is integrally connected to a substantially closed end 315 of a second cylinder 314 in concentric relation therewith, while the movable contact 7 is slidably sealingly fitted in the inner cylindrical member 316. Thus, a suction chamber 328 is defined by the inner peripheral surface of the second cylinder 314, the outer peripheral surface of the inner cylindrical member 316, second piston 327, and second cylinder 314. Openings 329 are provided in the peripheral wall of the contact 7, which when the circuit breaker is in its closed position, are closed with the inner peripheral surface of the inner cylindrical member 316, thereby blocking the communication between the axial hollow portion 8 and the suction chamber 328. With the aforesaid arrangement, until the movable contact 7 is moved a given distance away from the fixed contact, the axial hollow portion 8 in the contact 7 remains out of communication with the suction chamber 28. It is apparent that an arc produced between the both contacts is hard to extinguish, as far as a distance between the both contacts is short. Accordingly, it is advantageous that an arc extinguishing gas be blown against an arc between the both contacts, when a distance between the both contacts becomes a distance effective to extinguishing an arc.

Figure 10:
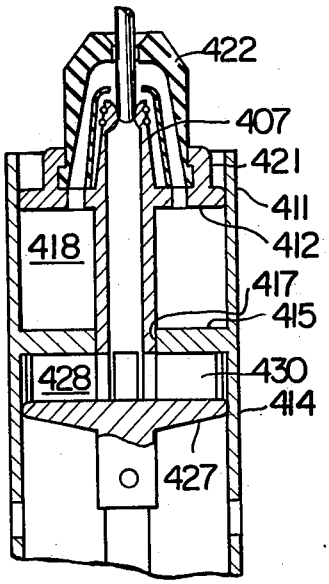
FIG. 10 is a cross-sectional view showing part of yet another embodiment of the circuit breaker according to the present invention.

FIG. 10 shows a still another embodiment of the present invention, wherein a first piston is movable and a first cylinder is fixed. In this case, as well, like parts are designated like reference numerals in common with those of FIG. 1. As in FIG. 1, a second cylinder 414 is secured to a vessel through the medium of a cylindrical insulating member. A first cylinder 411 is continuous through the medium of a common, substantially closed end 415, with a second cylinder 414 in opposed relation. The common, substantially closed end 415 has an opening 417 in its center, while a movable contact 407 is slidingly sealingly fitted in the opening 417. A first piston 412 which is slidably fitted in the first cylinder 411 is integrally connected to a movable contact 407 which extends through the center of the piston 412. A compression chamber 418 is defined by the inner peripheral surface of the first cylinder 411, the common, substantially closed end 415, first piston 412, and the outer peripheral surface of the movable contact 407.

The first piston 412 is formed with an annular flange 421 on the side opposite to the compression chamber 418, while an insulating nozzle 422 is secured to the annular flange 421 in a manner to surround the free end portion of the movable contact 407, as in FIG. 1.

A second piston 427 is integrally connected to the movable contact 407 at an end opposite to the free end thereof and slidably fitted in a second cylinder 414. Thus, a suction chamber 428 is defined by the common, substantially closed end 415, the inner peripheral surface of the second cylinder 414, the second piston 427, and the outer peripheral surface of the movable contact 407. Disposed in the suction chamber 428 is either one 430 of cooling means shown in FIGS. 1, 5, 7.

As described above, the first cylinder defining the compression chamber should not necessarily be connected to the movable contact. It is to be understood that although in FIGS. 1 and 2 the second cylinder defining the suction chamber is secured to a vessel, a suction chamber can be defined, even if the second cylinder is connected to the movable contact and the second piston is fixed.

Figure 11:
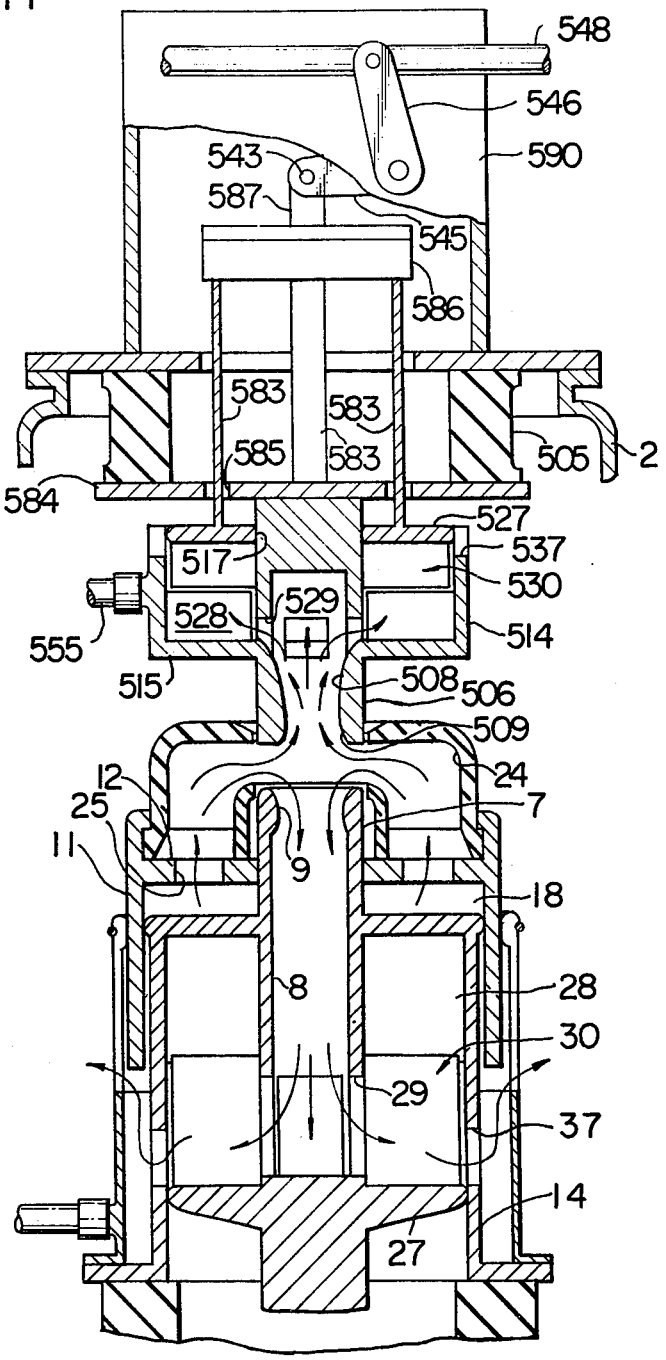
FIG. 11 is a cross-sectional view showing yet another embodiment of the circuit breaker according to the present invention.

FIG. 11 shows yet another embodiment of the invention, which includes a fixed contact having therein an axial hollow portion, and a second suction chamber. In this embodiment, as well, like parts are designated like reference numerals in common with those shown in FIG. 1.

Referring to FIG. 11, a fixed contact 506, which is secured through the medium of a tubular insulating member 505 and fixing disc 584 to a vessel 2, includes an axial hollow portion 508 therein. The axial hollow portions 508 has an opening 509 in that axial free end surface thereof which is opposed to the movable contact 7. A third cylinder 514 has a closed end 515 thereof, and the fixed contact 506 is integrally secured to the third cylinder 514 in a manner that the fixed contact 506 extends through the closed end of the cylinder 514 in concentric relation therewith. The third cylinder 514 has connected thereto a terminal 555.

A third piston 527 is slidably fitted in the third cylinder 514. The third piston 527 has an opening 517 in its center, with the fixed contact 506 slidably sealingly fitted in the central opening 517. A second suction chamber 528 is defined by the inner peripheral surface of the third cylinder 514, the outer peripheral surface of the fixed contact 506, a closed end 515 of the third cylinder, and third piston 527. Disposed in the second suction chamber 528 is a cooling means 530 which may be either one of those shown in FIGS. 1, 5, 7. Openings 529 are provided in the peripheral wall of the fixed contact 506, so that the axial hollow portion 508 in the fixed contact 506 may be communicated with the second suction chamber 528.

Integrally secured to the third piston 527 on the side opposite to the second suction chamber 528 are legs 583, only three of which are shown. The legs 583 are arranged at an equal angular spacing around the fixed contact 506. The legs 583 extend through apertures 585 provided in the fixed disc 584, terminate at the disc 586, and are secured to the disc 586. The disc 586 is formed with a stud 587 at its center, and the stud 587 is pivotally connected to one arm 545 of a 'L' shaped link by means of a pin 543. The other arm 546 of the 'L' shaped link is pivotally connected to a driving rod 546 by means of a pin 547. The driving rod 546 is coupled to an actuator not shown. This actuator may be operated in synchronism with an actuator (not shown) for driving the second piston 27. Alternatively, the second and third pistons 27, 527 may be driven by a single common actuator.

In operation, when the movable contact 7 is moved away from the fixed contact 506, an arc extinguishing gas in the compression chamber 18 is compressed, whereupon the volumes of the first and second suction chambers 28 and 528 are enlarged. When the both contacts are disengaged from each other, an arc extinguishing gas in the compression chamber 18 is directed, on one hand, via holes 25 provided in the substantially closed end 12 of the first cylinder 11, guide passages 24, opening 9, axial hollow portion 8 in the movable contact 7, and openings 29 into the first suction chamber 28 and is cooled by the cooling means 30. The arc extinguishing gas thus cooled is then discharged through openings 37 provided in the peripheral wall of the second cylinder 14 into the space in the vessel 2, as shown by arrows in the drawing. The arc extinguishing gas, on the other hand, is directed via the holes 25 in the substantially closed end 12, guide passages 24, opening 509, axial hollow portion 508 in the fixed contact 506, and openings 529 into the second suction chamber 528 and then cooled by the cooling means 530. The arc extinguishing gas thus cooled is discharged via radial slots 537 provided in the peripheral wall of the third cylinder 514 into the space in the vessel 2.

With the aforesaid arrangement, two streams of arc extinguishing gas are blown against an arc in the opposed directions, which arc is produced between the both contact 506 and 7, thereby improving arc extinguishing performance.

As is apparent from the foregoing descriptions of the puffer type gas-blast circuit breaker according to the present invention, the suction chamber or chambers have disposed therewithin cooling means, so that the arc extinguishing gas heated by an arc produced between the contacts and flowing into the suction chamber or chambers may be effectively cooled, thereby suppressing a pressure rise in the suction chabmer or chambers, and hence maintaining a large pressure difference between the compression chamber and the suction chamber or chambers, with the result that an arc extinguishing gas may be blown against an arc produced between the both contacts to extinguish the arc, and as a result the arcing time may be shortened.

What is claimed are:

1. A puffer type gas-blast circuit breaker including at least one interrupting unit mounted in a vessel filled with an arc extinguishing gas of a unitary pressure, said interrupting unit comprising:

a pair of contacts positioned in alignment with but in opposed relation to each other, and movable toward and away from each other to be engaged with and to be disengaged from each other respectively, at least one of said pair of contacts having therein an axial hollow portion, said axial hollow portion having an opening in that axial free end face of said one contact which is opposed to the other contact, wherein an arc is established between said pair of contacts, upon disengagement of said pair of contacts from each other;

a first cylinder and a first piston within said first cylinder to define a compression chamber filled with an arc extinguishing gas, said first cylinder and piston being movable relative to each other in association with the relative movement of said pair of contacts;

first communicating means for communicating said compression chamber with said axial hollow portion through said opening;

a second cylinder and a second piston within said second cylinder to define a suction chamber, said second cylinder and piston being movable relative to each other in association with the relative movement of said pair of contacts;

second communicating means for communicating said axial hollow portion with said suction chamber, wherein when said pair of contacts are relatively moved away from each other, an arc extinguishing gas in said compression chamber is compressed and a volume of said suction chamber is enlarged, and wherein when said pair of contacts are disengaged from each other, a pressure difference between said compression chamber and said suction chamber causes said arc extinguishing gas to be directed from said compression chamber via said first communicating means, said opening in said axial hollow portion and said second communicating means into said suction chamber, thereby to be blown against an arc produced between said pair of contacts; and means disposed in said suction chamber for cooling an arc extinguishing gas introduced into said suction chamber.

2. A puffer type gas-blast circuit breaker as set forth in claim 1, wherein said cooling means is secured to either one of said second cylinder and said second piston and includes a plurality of fin members, said fin members being circumferentially equi-distantly spaced apart from each other around an axis of said suction chamber and extending radially and axially, the adjacent two of said fin members defining therebetween arc extinguishing gas passages respectively, and said passages being communicated with said second communicating means.

3. A puffer type gas-blast circuit breaker as set forth in claim 2, wherein said interrupting unit further includes members disposed in said suction chamber and secured to the other one of said second cylinder and said second piston, said members substantially occupying spaces in said passages defined between said fin members, respectively.

4. A puffer type gas-blast circuit breaker as set forth in claim 2, wherein radially inner ends of some of said passages defined between said fin members are communicated with said second communicating means.

5. A puffer type gas-blast circuit breaker as set forth in claim 1, wherein said cooling means is secured to either one of said second cylinder and said second piston, and includes a plurality of ring-shaped discs axially spaced apart from each other, the adjacent two of said ring-shaped discs defining therebetween ring-shaped passages respectively, the radially inner circumferences of said ring-shaped passages being communicated with said second communicating means.

6. A puffer type gas-blast circuit breaker as set forth in claim 5, wherein said interrupting unit further includes a ring member disposed in said suction chamber and secured to either one of said second cylinder and said piston, said ring member substantially occupying a space between the radially outer circumferences of said ring-shaped passages and the radially inner peripheral surface of said second cylinder.

7. A puffer type gas blast circuit breaker as set forth in claim 1, wherein said interrupting unit further includes third communicating means for communicating said suction chamber with the space in said container when said pair of contacts are relatively moved a given distance away from each other.

8. A puffer type gas-blast circuit breaker as set forth in claim 1, wherein when said pair of contacts are in engagement with each other said second communicating means is closed, and when said pair of contacts are moved a given distance away form each other, said second communicating means is opened to communicate said axial hollow portion with said suction chamber.

9. A puffer type gas-blast circuit breaker as set forth in claim 1, wherein said second cylinder has a substantially closed end which is slidably fitted in said first cylinder to form said first piston.

10. A puffer type gas-blast circuit breaker as set forth in claim 1, wherein said interrupting unit further includes an insulating nozzle enclosing the free end portion of said one contact, said nozzle having therein a throat portion aligned with said pair of contacts, said throat portion being capable of being substantially blocked by the other of said contacts, said first communicating means including a space defined between the inner peripheral surface of said insulating nozzle and the outer surface of the free end portion of said one contact.

11. A puffer type gas-blast circuit breaker as set forth in claim 10, wherein said interrupting unit further includes third communicating means for communicating said suction chamber with the space in said vessel, when said pair of contacts are moved a given distance away from each other.

12. A puffer type gas-blast circuit breaker as set forth in claim 1, wherein said cooling means includes: a cylindrical member secured to either one of said second piston and said second cylinder in concentric relation therewith; a plurality of fin members circumferrentially equi-distantly spaced apart from each other around an axis of said cylindrical member and extending axially and radially, the radially outer ends of said fin members being secured to the inner peripheral surface of said cylindrical member, the adjacent two of said fin members defining arc extinguishing passages therebetween respectively, and said passages being communicated with said second communicating means.

13. A puffer type gas-blast circuit breaker as set forth in claim 12, wherein said interrupting unit further includes third communicating means for communicating said suction chamber with the space in said vessel, when said pair of contacts are moved a given distance away from each other.

14. A puffer type gas-blast circuit breaker as set forth in claim 13, wherein said third communicating means has at least one opening provided in the peripheral wall of said second cylinder.

15. A puffer type gas-blast circuit breaker as set forth in claim 14, wherein when that end surface of said cylindrical member in said cooling means which is remote from said second piston overlaps at least one opening provided in the peripheral wall of said second cylinder, said suction chamber is brought into communication with the space in said vessel.

16. A puffer type gas-blast circuit breaker as set forth in claim 1, wherein when said pair of contacts are engaged with each other said second communicating means is closed, and when said pair of contacts are relatively moved a given distance in the direction away from each other said second communicating means is opened to bring said axial hollow portion and said suction chamber into communication with each other.

17. A puffer type gas-blast circuit breaker as set forth in claim 16, wherein said second communicating means has at least one opening provided in the peripheral wall of said one contact.

18. A puffer type gas-blast circuit breaker as set forth in claim 1, wherein said one contact is movable and said the other contact is secured to said vessel.

19. A puffer type gas-blast circuit breaker as set forth in claim 18, wherein said first cylinder is connected to said movable contact, and said second piston is secured to said vessel.

20. A puffer type gas-blast circuit breaker as set forth in claim 19, wherein said second cylinder is secured to said vessel, and said second piston is connected to said movable contact.

21. A puffer type gas-blast circuit breaker as set forth in claim 18, wherein said first and second cylinders are secured to said vessel, and said first and second pistons are connected to said movable contact.

22. A puffer type gas-blast circuit breaker as set forth in claim 20, wherein said first cylinder has a substantially closed end; said movable contact extends through the substantially closed end of said first cylinder in coaxial relation therewith; said second cylinder has a substantially closed end having therein a hole in its center; said movable contact is sealingly slidably fitted in said central hole provided in the substantially closed end of said second cylinder; the substantially closed end of said second cylinder forms said first piston to define said first compression chamber on the side of said free end of said movable contact opposite to the substantially closed end of said first cylinder; said second piston is secured to that end of said movable contact opposite to said free end portion of said contact; said second piston cooperates with said second cylinder to define said suction chamber on the side of said compression chamber opposite to the substantially closed end of said second cylinder.

23. A puffer type gas-blast circuit breaker as set forth in claim 22, wherein said second communicating means has at least one hole provided in the peripheral wall of said movable contact; and said cooliing means is secured to said second piston and includes a plurality of fin members extending axially and radially from the outer periphery of said movable contact toward the inner periphery of said second cylinder, said fin members being circumferentially equi-distantly spaced apart from each other, the adjacent two of said fin members defining therebetween arc extinguishing passages respectively, and said passages being communicated with said at least one hole provided in the peripheral wall of said movable contact.

24. A puffer type gas-blast circuit breaker as set forth in claim 23, wherein said second communicating means has at least one hole provided in the peripheral wall of said movable contact; said cooling means is secured to said second piston and includes a plurality of ring-shaped discs, said ring-shaped discs extending from the outer periphery of said movable contact toward the inner periphery of said second cylinder and being axially spaced apart from each other, the adjacent two of said ring-shaped discs defining therebetween arc-extinguishing passages respectively, the radially inner ends of said passages being communicated with said at least one hole provided in the peripheral wall of said movable contact.

25. A puffer type gas-blast circuit breaker as set forth in claim 21, wherein said first cylinder and said second cylinder are connected to each other by means of a common, substantially closed end in coaxial relation, said common, substantially closed end having therein a hole in its center, said movable contact is sealingly slidably fitted in said central hole provided in said common, substantially closed end and extends through said first piston in concentric relation therewith; said first piston cooperates with said common, substantially closed end to define said compression chamber; said second piston is secured to that end of said movable contact opposite to said free end portion; said second piston cooperates with said common, substantially closed end to define said suction chamber.

26. A puffer type gas-blast circuit breaker as set forth in claim 25, wherein said second communicating means has at least one hole provided in the peripheral wall of said movable contact; and said cooling means is secured to said second piston and includes a plurality of fin members radially extending from the outer peripheral surface of said movable contact toward the inner peripheral surface of said second cylinder, said fin members being circumferentially spaced apart from each other, the adjacent two of said fin members defining therebetween arc extinguishing passages respectively, and said passages being communicated with said at least one hole provided in the peripheral wall of said movable contact.

27. A puffer type gas-blast circuit breaker as set forth in claim 22, wherein said second communicating means has at least one hole provided in the peripheral wall of said movable contact; and said cooling means includes a cylindrical member secured to said second piston in concentric relation therewith, and a plurality of fin members circumferentially spaced apart from each other around an axis of said cylindrical member and extending axially and radially, said fin members having radially outer ends thereof secured to the inner peripheral surface of said cylindrical member, the adjacent two of said fin members defining therebetween arc extinguishing passages respectively, and said passages being communicated with at least one hole provided in the peripheral wall of said movable contact.

28. A puffer type gas-blast circuit breaker as set forth in claim 1, wherein said other contact includes therein an axial hollow portion having an opening in that axial end face of the free end portion of said the other contact opposite to said one contact, wherein said first communicating means communicates said compression chamber with said axial hollow portion of said the other contact through said opening, and wherein said interrupting unit further includes a third cylinder and a third piston within said third cylinder to define a second suction chamber, said third piston and said third cylinder being movable relative to each other in association with the relative movement of said pair of contacts; fourth communicating means for bringing said axial hollow portion in said other contact and said second suction chamber in communication with each other, when said pair of contacts are relatively moved in the direction away from each other the volume of said second suction chamber being enlarged, and when said pair of contacts are disengaged from each other a pressure difference between said compression chamber and said second suction chamber causing an arc extinguishing gas in said compression chamber to be directed through said first communicating means, said opening in said other contact, said axial hollow portion in said other contact, and said fourth communicating means into said second suction chamber thereby to be blown against an arc produced between said pair of contacts; and means disposed in said second suction chamber for cooling an arc extinguishing gas flowing into said second suction chamber.

* * * * *